US010471729B2

(12) United States Patent
Ros Cerro et al.

(10) Patent No.: US 10,471,729 B2
(45) Date of Patent: Nov. 12, 2019

(54) PRINTING FLUID SUPPLY

(71) Applicant: HEWLETT-PACKARD DEVELOPMENT COMPANY, L.P., Houston, TX (US)

(72) Inventors: Francesc Ros Cerro, Sant Vincent de Montait (ES); Marc Bautista Palacios, Barcelona (ES); Macia Sole Pons, Sant Quirze del Valles (ES); Emilio Jose Gongora Canada, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/542,486

(22) PCT Filed: Jan. 30, 2015

(86) PCT No.: PCT/EP2015/051938
§ 371 (c)(1),
(2) Date: Jul. 10, 2017

(87) PCT Pub. No.: WO2016/119878
PCT Pub. Date: Aug. 4, 2016

(65) Prior Publication Data
US 2018/0272734 A1 Sep. 27, 2018

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC ..... B41J 2/175; B41J 2/17596
See application file for complete search history.

(56) References Cited

U.S. PATENT DOCUMENTS

| | | | |
|---|---|---|---|
| 7,004,573 | B2 | 2/2006 | Hewitt |
| 7,207,666 | B2 | 4/2007 | Ord et al. |
| 7,988,271 | B2 | 8/2011 | Ohnishi et al. |
| 8,066,648 | B1 | 11/2011 | Mark |
| 8,182,082 | B2 | 5/2012 | Chan et al. |
| 8,474,930 | B2 | 7/2013 | Rasmussen |
| 2004/0090501 | A1 | 5/2004 | Yoshida et al. |
| 2008/0239029 | A1 | 10/2008 | Hayashi et al. |
| 2014/0225945 | A1 | 8/2014 | Herman et al. |

FOREIGN PATENT DOCUMENTS

| | | |
|---|---|---|
| CN | 1689813 | 11/2005 |
| CN | 101189129 | 5/2008 |
| CN | 101274531 | 10/2008 |
| CN | 103561957 | 2/2014 |
| EP | 0823329 | 2/1998 |
| EP | 1386743 | 2/2004 |
| EP | 1886815 | 2/2008 |
| WO | WO-2012138323 | 3/2012 |

*Primary Examiner* — Lamson D Nguyen
(74) *Attorney, Agent, or Firm* — HP Inc. Patent Department

(57) ABSTRACT

An example of a printing fluid supply connector is described that has a first connector and a second connector, where each of the first and second connectors is to fluidly connect to a respective replaceable reservoir of printing fluid. The printing fluid supply connector also has an outlet to fluidly connect to a printer and a selector to selectively fluidly connect one of the first and second connectors to the outlet in response to an electrical control signal or to fluid pressure at the first and second connectors.

13 Claims, 3 Drawing Sheets

PRINTING FLUID SUPPLY

Printers that use printing fluids such as inks are connected, in use, to suitable reservoirs of such printing fluids, for example ink cartridges. In some systems a printer fluid supply connector may be used to connect the printer to the printer fluid reservoir.

Examples will now be described by way of non-limiting example only, with reference to the accompanying drawings, in which.

Figure 3A:
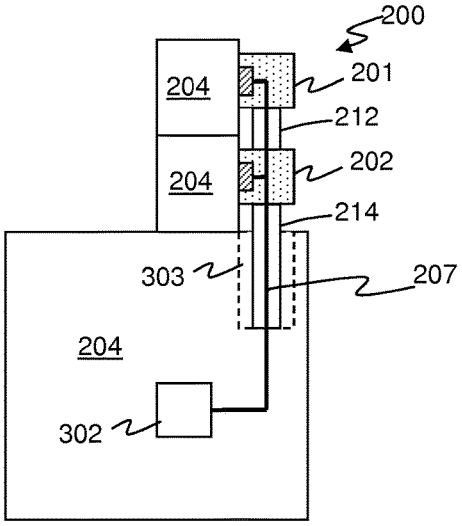
Figure 3B:
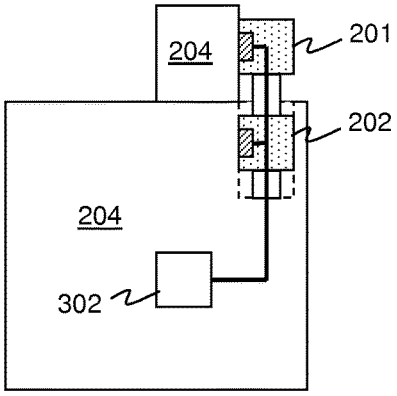
Figure 4:
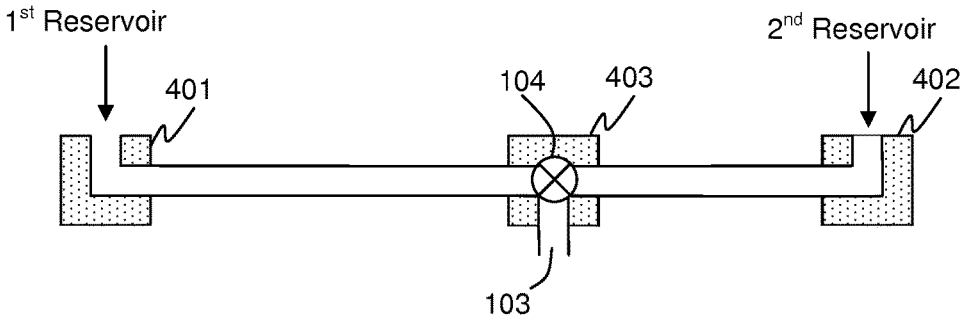
Figure 5:
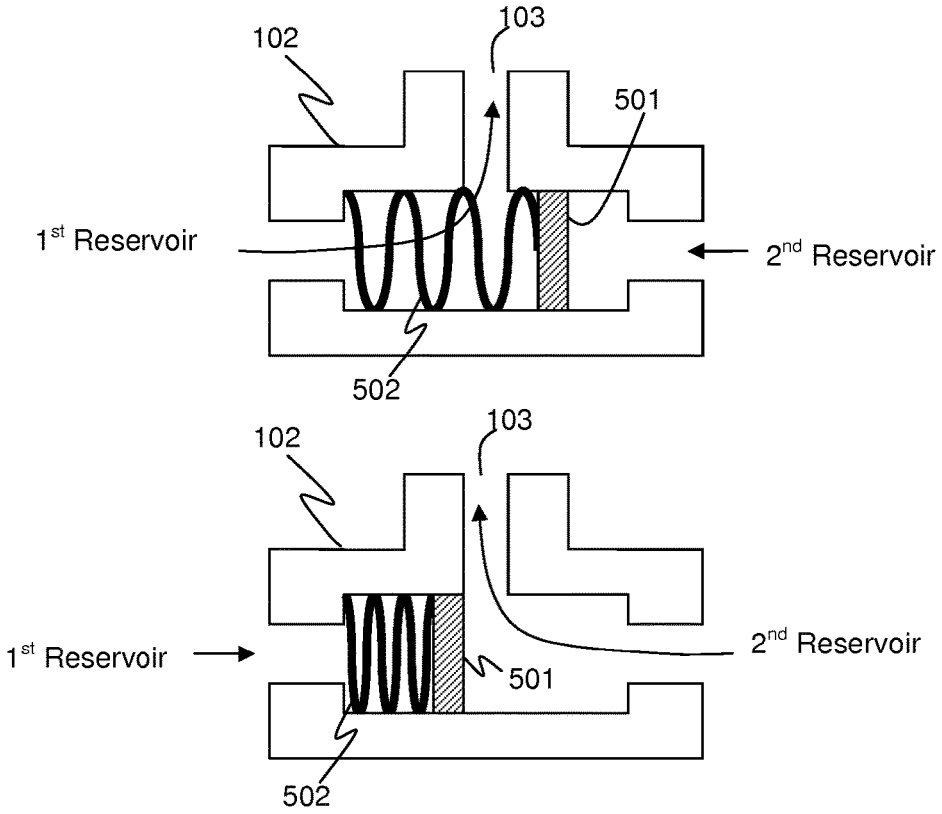
Figure 6:
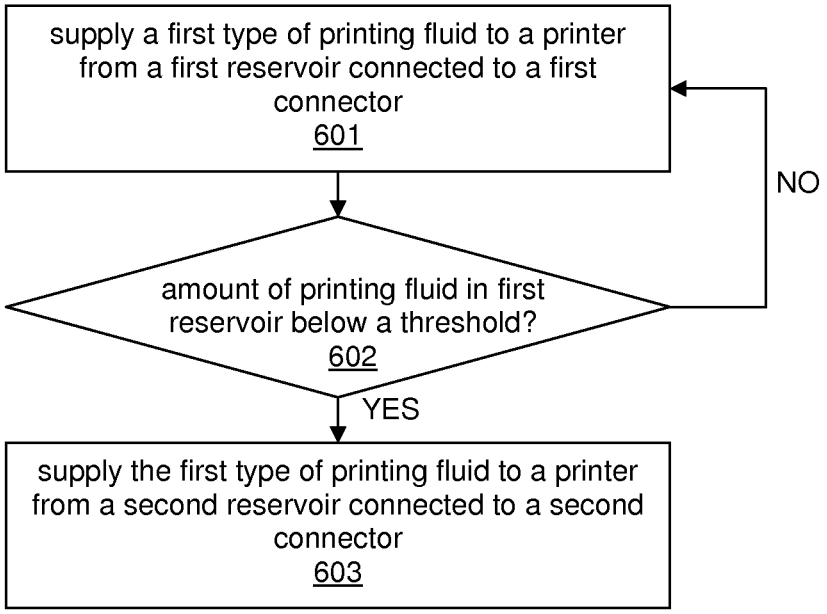

FIGS. 3*a* and 3*b* illustrate an example of a printer having a printing fluid supply connector for connecting to multiple reservoirs with FIG. 3*a* illustrating the printer with two reservoirs connected and FIG. 3*b* illustrating the printer with one reservoir connected;

FIG. 4 illustrates a further example of a printing fluid supply connector;

FIG. 5 illustrates an example of a connector with a selector that operate based on fluidic pressure; and FIG. 6 is a flowchart of an example of a method of controlling supply of printing fluid.

Many printers operate using printing fluids such as inks and some may also use treatment fluids such as fixer or binder or optimiser or the like. The printing fluids may be supplied from replaceable reservoirs of the printing fluids, such as Ink cartridges, which in some examples may be a bag-in-a-box type of ink cartridge although other types of replaceable reservoir may be used in other examples.

The printing fluid reservoirs, e.g. ink cartridges, may be fluidly connected to the printer by an appropriate printer fluid supply connector. In some examples the printer fluid supply connector for a particular type of printing fluid, e.g. a particular colour ink or type of treatment fluid, may be designed so as to operatively connect solely to the right type of printer fluid reservoir, for example a supply connector for black ink may be designed so as to correctly interface with a black ink cartridge and may not be able to correctly connect to a cartridge of cyan ink.

In use the printer will use the printing fluid from the reservoirs for the particular print jobs. When the reservoir for a particular type of printing fluid, for example a particular colour of ink, is depleted it may then be replaced with a new replacement reservoir by an operator of the printer.

Figure 1:
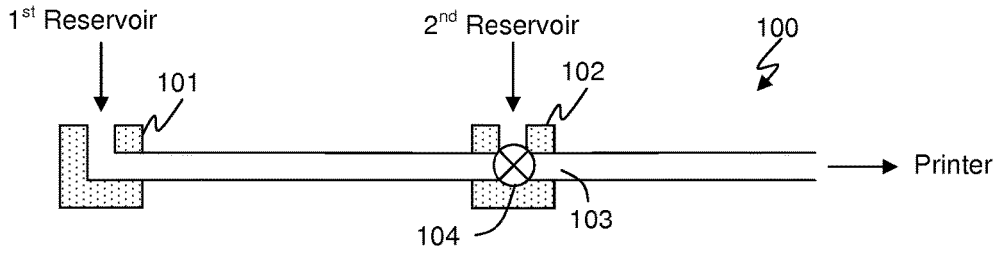
FIG. 1 is an illustration of an example of a printing fluid supply connector.

An example of a printing fluid supply connector is shown in FIG. 1. The printing fluid supply connector 100 has a first connector 101 to fluidly connect to a first replaceable reservoir of printing fluid, e.g. an ink cartridge or a supply of treatment fluid. The printing fluid supply connector 100 also has a second connector 102 to fluidly connect to a second, different, replaceable reservoir of printing fluid, e.g. another ink cartridge or supply of treatment fluid. An outlet 103 fluidly connects to a printer. The printing fluid supply connector 100 also has selector 104 that selectively fluidly connects one of the first and second connectors to the outlet in response to an electrical control signal or to fluid pressure at the first and second connectors. The selector 104 may comprise a valve arrangement, i.e. at least one valve, which may be controlled to provide a fluidic pathway from the first connector 101, and from a first printing fluid reservoir connected to the first connector, to the outlet and thus to the printer. The at least one valve may also be controlled to provide a fluidic pathway from the second connector 102, and from a second printing fluid reservoir connected to the second connector, to the outlet and thus to the printer.

Printing fluid supply connectors such as illustrated in FIG. 1 thus provide the ability for a supply from multiple separate printing fluid reservoirs. FIG. 1 illustrates a dual supply with connectors for connecting to two separate reservoirs but in other examples there may be more than two connectors for connecting to more than two reservoirs.

Thus if a printing fluid reservoir that is connected to one of the first or second connectors does not contain sufficient printing fluid to be able to complete a print job, instead of replacing the reservoir an additional reservoir may be connected to the other connector. For example if there is a partially depleted printing fluid reservoir connected to the first connector 101, which contains insufficient printing fluid, an additional printing fluid reservoir may be connected to the second connector 102. The selector 104 may connect the first connector, and thus the first printing fluid reservoir, to the outlet 103 and thus to the printer. The printing fluid from the first reservoir may therefore be used until the amount of printing fluid is below a threshold, for example the first printing fluid reservoir is empty or nearly empty. At this point the selector may operate to connect the second connector 102, and hence the second reservoir, to the outlet 103 and hence to the printer. This may occur automatically, as will be described later with respect to FIG. 6, and thus there is no need for operator intervention and no significant printing pause.

In this way substantially all, or a defined proportion, of the printing fluid in the reservoir connected to one connector, e.g. the first connector 101, may be used by the printer. The printing fluid reservoir connected to such connector may then be removed, e.g. for disposal. The printer may continue to operate with the printing fluid reservoir connected to the other connector, e.g. the second connector 102. At any point in time, for example if the amount of printing fluid in the reservoir connected to the second connector 102 is deemed to be insufficient, a new reservoir may be connected to the first connector 101. When the reservoir connected to the second connector 102 is depleted to a predetermined amount the selector may selectively connect the outlet 103 back to the first connector 101.

Printing fluid reservoirs may therefore be depleted more fully than would be the case with a single reservoir connector without any increased printer pause or need for operator intervention and without using larger reservoirs. Thus the amount of wastage of printing fluid can be greatly reduced compared with using a single printing fluid reservoir.

As mentioned above some printing fluid reservoirs are designed to be used with corresponding connectors for that type of printing fluid, thus for example a yellow ink cartridge may be designed to operate with a corresponding supply connector. For the printing fluid supply connected such as illustrated in FIG. 1 the first and second connectors are to operate with the same type of printing fluid and thus both the first and second connectors are suitable for interfacing with a printing fluid reservoir for the same type of printing fluid. Thus, for example, for a printing fluid supply connector for a particular colour ink both of the first and second connectors can interface with reservoirs for that colour of ink.

In some examples therefore the first and second connectors may therefore have a specific shape or configuration to interface or mate with a corresponding connector of the printing fluid reservoir. For example the first and second connectors may comprise a socket which co-operates with a matching plug of the printing fluid reservoir, or vice versa.

Figure 2:
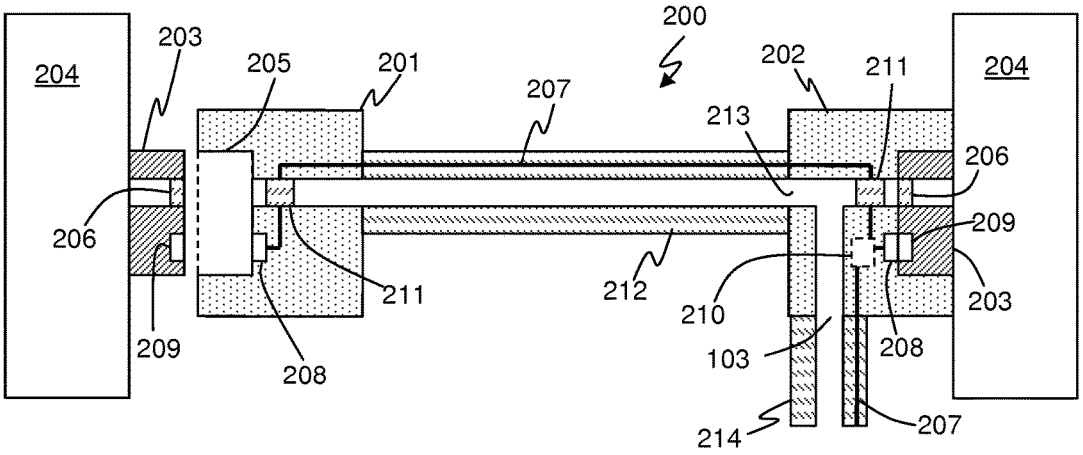
FIG. 2 is an illustration of another example of a printing fluid supply connector and how it may connect to reservoirs of printing fluid.

FIG. 2 illustrates another example of a printing fluid supply connector 200 and illustrates how the connector may interface with printing fluid reservoirs. The printing fluid supply connector again has a first connector 201 and a second connector 202. In this example each of the first and second connectors is to cooperate with an interface 203 of a printing fluid reservoir 204, which may be a particular type of printing fluid. e.g. a particular colour ink cartridge or type of treatment fluid.

In the example shown in FIG. 2 the first and second connectors 201 and 202 may comprise a socket with at least one recess 205 and the interface 203 of the reservoir may comprise a plug portion, although other arrangements are possible and may be used. FIG. 2 shows the first connector 201 separated from the interface 203 of the relevant reservoir 204 and the second connector 202 in the mated position.

The reservoir 204 may comprise a valve 206 which may for example be located in the interface, e.g. In a septum, where the valve is closed when the reservoir is not connected to a suitable connector but is opened when the reservoir is connected to a suitable connector.

In some examples the printing supply connector has a signal path 207 to communicate to the printer whether or not a reservoir of printing fluid 204 is connected to the first connector 201 and whether or not a reservoir of printing fluid is connected to the second connector 202. Thus the printer may be able to determine what reservoirs, if any, are connected to the first and second connectors 201 and 202. The printing fluid supply connector may therefore have at least one interface 208 for presence detection.

The interface 208 for presence detection could be a sensor. The sensor could be, for example, a mechanical contact switch that changes state on connection or disconnection of a reservoir or a sensor based on some property change when the reservoir is connected or disconnected, e.g. resistance, capacitance, optical transmission or reflection etc. The interface sensor 208 could additionally or alternatively be at least partly fluidic to indicate connection of a reservoir with available printing fluid supplies. FIG. 2 illustrates an interface 208 in each of the first and second detectors but a fluidic sensor could be located anywhere in the flow paths from the connectors.

In some examples the printing fluid reservoirs may be provided with apparatus that can be used to communicate with the printer when connected. For instance the printing fluid reservoir may include an identifier which could for example be an integrated circuit 209. In other words the reservoirs, e.g. ink cartridges may include a smart chip for identification purposes, although other arrangements such as RFID tags or visually readable labels such as barcodes may additionally or alternatively be used.

In such examples the interface 208 could be an interface reading information from the reservoir. Thus the first connector 201 may have a first interface 208 to communicate with a reservoir of printing fluid connected to the first connector 201 and the second connector 202 may have a second interface 208 to communicate with a reservoir of printing fluid connected to the second connector 202. The signal path 207 may then provide communication between the first and second interfaces and the printer. An interface 208 may be an interface for interfacing with the integrated circuit 209 of the reservoir, in which case the interface may simply be some electrical contacts for establishing a signal path between the printer and the integrated circuit 209 of the reservoir 204.

The integrated circuit 209 may contain information readable by the printer regarding the reservoir and/or its contents. For instance the readable information may identify at least one of: the type of printing fluid, e.g. colour of ink, the identity of the manufacturer, information about compatibility with particular printers, an ink expiration date or duration, and/or an indication of the amount of printing fluid in the reservoir.

The signal path 207 may therefore be able to communicate to the printer the amount of printing fluid in any reservoir 204 of printing fluid connected to the first connector 201 and also the amount of printing fluid in any reservoir 204 of printing fluid connected to the second connector 202. The printer can thus determine the total amount of printing fluid available in the connected reservoirs.

In some examples the signal path 207 may run to the interface 208 of one connector, e.g. the second connector, and onward to the interface 208 of the other connector, e.g. the first connector. In some examples however the signal path 207 may comprises branches running to the interfaces 208 of the first and second connectors 201 and 202. In some example circuitry 210, such as a switch or demultiplexer may be located to allow the printer to switch to establish communication between the printer and the interface 208 of the first connector 201 or the interface 208 of the second connector 202. The term signal path shall therefore include a path or network having multiple branches and shall generally mean any suitable communication link for communicating signals.

The signal path 207 may in some examples comprise a communications bus such as an $I^2C$ bus although other serial transfer protocols could be used or the bus could allow for parallel data transfer.

The printer may therefore be able to determine whether there is a reservoir 204 of printing fluid connected to the first connector 201 and also whether there is a reservoir 204 of printing fluid connected to the second connector. If a reservoir 204 of printing fluid is connected to the first connector 201 and no reservoir of printing fluid connected to the second connector 202, then the first connector may be fluidly connected to the outlet 103 for supply to the printer. If a reservoir 204 of printing fluid is connected to the second connector 202 and no reservoir of printing fluid connected to the first connector 201, then the second connector may be fluidly connected to the outlet 103 for supply to the printer. The printing fluid supply connector may therefore be operable with a just a single reservoir connected and with the single reservoir connected to either of the first or second connectors.

If however there is a reservoir of printing fluid connected to the first connector 201 and also a reservoir of printing fluid connected to the second connector 202 then one of the reservoirs can be selected by selectively fluidly connecting one of the first or second connectors to the outlet 103 for supply to the printer.

In some examples the printer may select the reservoir for use. The printer may use the currently selected reservoir until it is exhausted and then swap to the other reservoir and/or may select the reservoir with the shortest time remaining till an expiration date, if applicable.

In the example of FIG. 2 each of the first and second connectors 201 and 202 has a controllable valve 211 that may be controlled to allow or block a flow path from an inlet of the relevant connector to the outlet 103. The valves 211 thus collectively operate as a selector to selectively fluidly connect one of the first and second connectors to the outlet.

The selection may be electrical, for instance via signal path 207, which may comprise separate or shared branches for communication with the interface 208 and control of the valve 211. In other words the selector may selectively fluidly connect the first connector 201 or the second connector 202 to the outlet in response to a control signal received from the printer.

In some examples the selection may be at least partly fluidic and may involve at least some fluid pressure for a flow path to be established. In some examples the selector may have at least one valve to selectively fluidly connect one of the first and second connectors to the outlet based on a difference in fluid pressure at the first and second connectors. In other words there may be at least one valve which operates mechanically based on fluid pressure or a difference in fluid pressure in flow paths connected to the first and second connectors. For example referring back to FIG. 1 the selector 104 may comprise a mechanical valve that operates automatically based on pressure as will be described in more detail below.

The printer may therefore be able to communicate, via a suitable signal path, with the first and second connectors 201 and 202 and with any reservoirs connected to those connectors to determine information about the supplies within each reservoir and/or to select a particular reservoir for use.

A printer could be designed to operate with a printing fluid supply connector as described herein. In some instance however a printing fluid supply connector as described herein could be retrofit to an existing printer that previously used a printing fluid supply connector with a single connector. The printing fluid supply connectors described herein may provide a single outlet for supply of printing fluid to the printer and may also make use of existing signal path connections to the printer for communication with the reservoirs and so no physical change to the printer may be involved. The printer operating or control system may need to be updated to recognise that two separate supplies of the same type of printing fluid may be connected to the same inlet of the printer but this may be done by updating the machine readable instructions with the printer that define the relevant part of the operating system, e.g. by a software or firmware update.

In some examples it may be possible to use a printing fluid supply connector for a printer even where the printer itself is not set up to control separate supplies. Circuitry 210 of the printing fluid supply connector could comprise a circuit to read information from any connected reservoirs and provide communication with the printer as if there was a single supply.

For example if there was just one reservoir connected to one of the first and second connectors 201 or 202 then the circuitry 210 could simply relay communication signals from the printer to the relevant interface 208. However if reservoirs were connected to both the first and second connectors 201 and 202 then the circuitry 210 could communicate with both interfaces and translate the data to represent a virtual single combined reservoir. For instance amount of printing fluid available in each reservoir could be combined to a total amount and communicated to the printer as a single amount, possibly limited to the maximum amount expected in a single reservoir if necessary to avoid error.

In such an example the circuitry 210 may therefore control the selector to select the appropriate reservoir for use. The circuitry 201 could for example control valves, such as valves 211 of the first and second connectors 201 and 201, to swap between the reservoirs as necessary. The printer would thus simply receive an uninterrupted supply of printing fluid.

In the example of FIG. 2 the first connector may have a single flow path and may be fluidly connected to the second connector by any suitable fluidic connector such as tubing 212. For ease of connecting to different arrangements of reservoirs the tubing 212 may be a flexible hose or similar. At least one wire or conductive path for forming the signal path 207 may be arranged inside, outside or at least partly contained within the tubing 212.

The second connector in this example provides two flow paths and thus has two inlets and an outlet 103. One inlet 213 may be to receive printing fluid from the first connector via tubing 212. The second inlet may be the inlet for receiving printing fluid from a reservoir connected to the second connector. The outlet 103 of the second connector may be connected to a flow path such as tubing 214 to connect to an inlet of the printer. Tubing 214 may be a flexible hose or similar. At least one wire or conductive path for forming the signal path 207 may be arranged inside, outside or at least partly contained within the tubing 214.

The printing fluid supply connector may be used to connect more than one reservoir of printing fluid to a printer. FIG. 3*a* shows an example of a printer 301 with a printing fluid supply connector 200 to connect to two separate reservoirs 204 of the same type of printing fluid, e.g. two different ink cartridges of the same colour ink. Similar components as described above in relation to FIG. 2 are identified by the same reference numerals. The printing fluid supply connector 200 has a first inlet, fluidly connected to a first connector 201, to receive printing fluid of a first type from a first reservoir of printing fluid and a second inlet, fluidly connected to a second connector 202, to receive printing fluid of a first type from a second reservoir of printing fluid. A supply controller 302 controls supply of the printing fluid of the first type from the first reservoir or from the second reservoir. The supply controller may for instance be a control module of the printer for controlling valves (not shown in FIG. 3*a*) in the printing fluid supply connector, for example via signal path 207.

The supply controller may be implemented at least partly as dedicated hardware and/or at least partly as part of the operating or control system or some other processing routine of the printer. The supply controller may control supply of the printing fluid from the first reservoir when the second reservoir is not available and control supply of the printing fluid from the second reservoir when the first reservoir is not available. When both the first and second reservoirs are available the supply controller may selectively control supply of the printing fluid from the first or the second reservoir.

As illustrated in FIG. 3*a* each of the first and second connectors may connect to a respective reservoir of printing fluid that is located external to a housing of the printer 301. Some printers are designed to allow operation with reservoirs of printing fluid that are located externally to the body of the printer, for instance on top of the printer. For such printers there are no space constraints due to the design of the printer body regarding the use of multiple reservoirs of printing fluid. For example as illustrated in FIG. 3*a* one reservoir may be stacked on top of another in some instances, although other arrangements such as side-by-side are also possible.

The first and second connectors 201 and 202 may be spaced so as to allow ease of connection to separate reservoirs 204. Where the first connector 201 is fluidly connected to the second connector 202 the fluid connection may for instance be a flexible hose 212 to allow for reservoirs to be connected in different ways. Likewise the fluidic connection with the printer may be a flexible hose 214.

In some examples the printing fluid supply connector may be extended from the printer to allow connections to both connectors 201 and 202 to be made but may be at least partly stowed when a connection to just one of the connectors, e.g. the first connector, is to be made. For example the fluidic connection 214 to the printer may be telescopic or otherwise extending and in some examples there may be a stowage area such as recess 303 within the printer body from which to extend the printing fluid supply connector 200.

FIG. 3*a* shows an example of the printing fluid supply connector 200 in an extended state with reservoirs connected to both of the first and second connectors 201 and 202. FIG. 3*b* shows an example where just the first connector 201 is connected to a reservoir and the second connector 202 is stowed.

In some examples the first connector and second connector may each provide a single fluid pathway but the first and second connectors may be connected to a flow combiner, e.g. an element which combines flow paths from multiple inlets. FIG. 4 illustrates an example where a first connector 401 is to connect to a first reservoir and a second connector 402 is to connect to a second reservoir. Each of the first and second connectors 401 and 402 provide a single flow path to flow combiner 403 which has two inlets and an outlet 103 to connect to a printer. In this example a selector, which may comprise at least one valve, is located in the flow combiner but there may additionally or alternatively be valves or other flow controlling elements in one or both of the first and second connectors.

As mentioned above in some examples the selector for fluidly connecting the first reservoir or the second reservoir may be a valve, such as a mechanical valve, that operates based on fluid pressure of the printing fluid at the first and second connectors, i.e. the fluid pressure from the fluid in the reservoirs. FIG. 5 illustrates an example of a selector, such as may be included in the second connector 102. The connector 102 may thus have inlets for receiving printing fluid from the first and second connectors. Both inlets may connect to a chamber in fluid connection with the outlet 103. In this example a movable diaphragm 501 is located in the chamber. The diaphragm 501 effectively seals one part of the chamber from the other and is movable so as to connect either the flow path from the first reservoir or the flow path from the second reservoir to the outlet 103. In this example the diaphragm is biased by a biasing element 502 such a spring. The biasing member biases the diaphragm with a biasing force to a bias position, which in this example connects the first reservoir with the outlet, as illustrated in the top part of FIG. 5. If the fluid pressure in the flow path from the first reservoir is approximately the same as the fluid pressure in the flow path from the second reservoir, as would be the case if both reservoir were full say, then the biasing force will result in the diaphragm being at this bias position, thus the first reservoir will be selected for use. If however the fluid pressure exerted from the second reservoir is greater than that exerted by the first reservoir by an amount greater than the biasing force the diaphragm may be move to the position illustrated in the lower part of FIG. 5, where the second reservoir is fluidly coupled to the output. By appropriate choice of the biasing force flow from the second reservoir may commence only when the first reservoir is substantially depleted.

FIG. 6 illustrates an example of a method of controlling supply of printing fluid. In the method a first type of printing fluid is supplied 601 to a printer from a first reservoir connected to a first connector of the printer. If the amount of printing fluid in the first reservoir is not below 602 a threshold then the first type of printing fluid continues to be supplied from the first reservoir. When however the amount of printing fluid in the first reservoir is below 602 the threshold the first type of printing fluid is supplied 601 to the printer from a second reservoir connected to a second connector of the printer. The first reservoir or the second reservoir is selected in response to an electrical control signal or fluid pressure of the first and second reservoirs.

The method may involve determining when reservoirs are connected to both the first and second connectors. Both the first and second connectors may be located externally to a body or housing of the printer.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

Features described in relation to one example may be combined or replaced by features described in relation to another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A printing fluid supply connector comprising:

a first connector and a second connector, wherein each of the first and second connectors is to fluidly connect to a respective replaceable reservoir of printing fluid, and wherein each of the first and second connectors comprises an interface to communicate with the respective replaceable reservoir;

an outlet to fluidly connect to a printer;

a selector to selectively fluidly connect one of the first and second connectors to the outlet in response to an electrical control signal or to fluid pressure at the first and second connectors;

a signal path to provide communication between the interface of each interface and the printer.

2. The printing fluid supply connector of claim 1 wherein the selector is to selectively fluidly connect the first connector or the second connector to the outlet in response to an electrical control signal received from the printer.

3. The printing fluid supply connector of claim 2 wherein the selector comprises a first controlled valve in the first connector and a second controlled valve in the second connector and a signal path to provide communication between the first and second controlled valves and the printer.

4. The printing fluid supply connector of claim 1 wherein the selector comprises a valve to selectively fluidly connect one of the first and second connectors to the outlet based on a difference in fluid pressure at the first and second connectors.

5. The printing fluid supply connector of claim 1 wherein the signal path is further to communicate to the printer whether or not a reservoir of printing fluid is connected to the first connector and whether or not a reservoir of printing fluid is connected to the second connector.

6. The printing fluid supply connector of claim 1 comprising a switch to establish communication between the printer and the first interface or the second interface.

7. The printing fluid supply connector of claim 1 wherein the signal path is to communicate to the printer the amount of printing fluid in any reservoir of printing fluid connected to the first connector and also the amount of printing fluid in any reservoir of printing fluid connected to the second connector.

8. The printing fluid supply connector of claim 1 wherein each of the first and second connectors is to connect to the respective reservoir of printing fluid that is located external to a housing of the printer.

9. A printer comprising:

a printing fluid supply connector comprising a first inlet to receive printing fluid of a first type from a first reservoir of printing fluid and a second inlet to receive printing fluid of a first type from a second reservoir of printing fluid; and a valve arrangement to control supply of the printing fluid of the first type from the first reservoir or from the second reservoir in response to an electrical control signal; and a supply controller to generate said electrical control signal, wherein the first inlet is fluidly connected to a first connector, wherein the first connector is to connect to the first reservoir of printing fluid and comprises a first interface to communicate with the first reservoir of printing fluid, and wherein the second inlet is fluidly connected to a second connector, wherein the second connector to connect to the second reservoir of printing fluid and comprises a second interface to communicate with the second reservoir of printing fluid.

10. The printer of claim 9 wherein the supply controller is to:

control supply of the printing fluid from the first reservoir when the second reservoir is not available;

control supply of the printing fluid from the second reservoir when the first reservoir is not available; and selectively control supply of the printing fluid from the first or the second reservoir when both the first and second reservoirs are available.

11. The printer of claim 9 wherein the supply controller is to communicate with the first reservoir of printing fluid when connected to the first connector to determine the amount of printing fluid in the first reservoir and is to communicate with the second reservoir of printing fluid when connected to the second connector to determine the amount of printing fluid in the second reservoir.

12. A method of controlling supply of printing fluid to a printer wherein:

a first type of printing fluid is supplied to the printer from a first reservoir connected to a first connector of the printer until the amount of printing fluid in the first reservoir is below a threshold, the first connector comprising a first interface to communicate with the first reservoir of printing fluid; and subsequently the first type of printing fluid is supplied to the printer from a second reservoir connected to a second connector of the printer, the second connector comprising a second interface to communicate with the second reservoir of printing fluid;

wherein the first reservoir or the second reservoir is selected in response to an electrical control signal or fluid pressure of the first and second reservoirs.

13. A method as claimed in claim 12 wherein the first and second reservoirs are located external to a housing of the printer.

* * * * *